United States Patent [19]

Gunness

[11] Patent Number: 4,685,532

[45] Date of Patent: Aug. 11, 1987

[54] CONSTANT DIRECTIVITY LOUDSPEAKER HORN

[75] Inventor: David W. Gunness, Niles, Mich.

[73] Assignee: Electro-Voice, Inc., Buchanan, Mich.

[21] Appl. No.: 832,155

[22] Filed: Feb. 21, 1986

[51] Int. Cl.[4] ..... G10K 11/00

[52] U.S. Cl. ..... 181/185; 181/187; 181/192

[58] Field of Search ..... 181/159, 184–187, 181/191, 192, 195

[56] References Cited

U.S. PATENT DOCUMENTS

| | | | |
|---|---|---|---|
| 2,203,875 | 6/1940 | Olson | 181/187 |
| 2,537,141 | 1/1951 | Klipsch | 181/187 |
| 3,852,529 | 12/1974 | Schaffer | 181/192 X |
| 4,091,891 | 5/1978 | Hino et al. | 181/185 |
| 4,325,456 | 4/1982 | Ureda | 181/185 X |
| 4,390,078 | 6/1983 | Howze et al. | 181/185 |

FOREIGN PATENT DOCUMENTS

| | | | |
|---|---|---|---|
| 215071 | 4/1924 | United Kingdom | 181/185 |
| 247532 | 7/1927 | United Kingdom . | |
| 495594 | 11/1938 | United Kingdom . | |

*Primary Examiner*—Benjamin R. Fuller
*Attorney, Agent, or Firm*—Darby & Darby

[57] ABSTRACT

A high-frequency constant-directivity horn including a relatively large throat driver and a relatively large throat for receiving sound from the driver, further includes a pair of vanes mounted wholly within the throat, respectively above and below the longitudinal axis in a vertical plane, for effectively dividing the throat into three smaller "pseudo horns" for directing and shaping sound waves from the transducer up to the point of termination of the vanes, beyond which the individual wavefronts mix within and fill a slot in a middle section of the horn, forming a coherent wavefront for passage into a front section of the horn and transmission therefrom, substantially free from wave interference and beaming effects.

15 Claims, 8 Drawing Figures

CONSTANT DIRECTIVITY LOUDSPEAKER HORN

FIELD OF THE INVENTION

The field of the present invention relates to horn-type loudspeakers, and more particularly to horn-type loudspeakers providing uniform polar frequency-response plots in both the horizontal and vertical planes.

BACKGROUND OF THE INVENTION

Many attempts have been made in the prior art to improve the frequency response characteristics of horn-type loudspeakers. Typically, a horn-type loudspeaker includes a driver connected to an initial throat section of the horn, with the throat section opening into either a middle or frontal section of the horn. One example is shown in British Pat. No. 247,532, completed for acceptance in July 5, 1927, where a horn-type sound amplifier is disclosed having a plurality of metal plates mounted on vibration insulators within a frontal portion of the horn, so that the plates are free to vibrate in response to high frequency vibrations, for producing an effective amplification of the sound at those frequencies. Another example is shown in British patent application No. GB200668A, filed on June 27, 1978, and taking priority from U.S. application Ser. No. 810,642, filed June 27, 1977 now ABN, which discloses a horn-type loudspeaker system having a substantially elongated throat section for improving the uniformity of the frequency response characteristic of the loudspeaker.

A loudspeaker horn taught in British patent specification No. 495,594, accepted on Nov. 16, 1938, discloses the use of vertical partition walls within the frontmost portion of the loudspeaker horn for subdividing this portion into horn sections that vary exponentially in cross-section, for improving the frequency response of the horn. In this example, the throat section of the horn is small in comparison to the wavelengths of the frequencies that are to be projected via the horn.

In U.S. Pat. No. 2,537,141, issued on Jan. 9, 1951, a loudspeaker horn is disclosed having vertical deflectors located within a middle section of the horn, and curved horizontal baffles within a frontal and forwardmost section of the horn, for both improving the middle and high audio frequency response, and increasing the angle of radiation of sound from the horn area. The deflectors in the middle section of the horn cause sound to diffuse in one plane, whereas the deflectors in the forwardmost section of the horn cause sound to diffuse in a plane that is perpendicular to the plane of diffusion of the middle or center section of the horn. The exit mouth of the horn is semicircular or terminates in an arc.

U.S. Pat. No. 3,852,529, issued Dec. 3, 1974, teaches the use in an acoustic horn of spaced longitudinal ribs extending into the horn for reducing the cross-sectional area of its throat for minimizing phase cancellation between transmitted acoustic wavefronts, and for providing a broadband impedance transformation. The ribs extend from the mouth of the loudspeaker horn into the throat of the horn near the driver connected to the back of the throat. Also, illustrated in FIG. 2 of this patent is what is described as a prior art horn having a "phase correction plug therein to reduce the phase cancellation problem." The phase correction plug is shown to have a plurality of passages of substantially constant path length between a diaphragm of a transducer connected at the back end of the throat and the entry into the major portion of the horn, for correcting phase cancellation at high frequencies. The use of such a plug is further described as a technique that "provides some phase cancellation correction, the correction is not complete because the length of the pasages is not identical, and the plug may have an adverse effect on other performance characteristics of the horn. Furthermore, the plug must be made to close tolerance specifications and the distance between the cone and the plug is critical."

In U.S. Pat. No. 4,091,891, issued on May 30, 1978, a horn speaker is disclosed having within the sound passage of the horn two partition walls extending from the throat to the mouth of the horn, and arranged symmetrically with respect to the principal axis to the horn for dividing the horn into three sound passages. The outer two sound passages are curved and greater in length than the central most sound passage about the principal axis of the horn, for both increasing the width of the angle of sound distribution from the horn and for improving the frequency response characteristics of the horn.

In U.S. Pat. No. 4,325,456, issued Apr. 20, 1982, an acoustical transformer or a phasing plug is disclosed for coupling the sound from an annular diaphragm to the throat of a compression-type loudspeaker, for improving the impedance match between the output of a driver or annular diaphragm connected to the input or entry port of the horn. The phasing lug is formed from a cone having spaced radially slots or channels formed therein connecting the truncated surfaces of the cone, for forming air passageways for propagation of sound waves, so that the channels are tapered such that the cross-sectional areas of the channels increase from their inlet ends near the speaker diaphragm, towards their outlet ends positioned at the throat of the horn.

Another example is shown in U.S. Pat. No. 4,390,078, issued June 28, 1983, where a loudspeaker horn is disclosed including a central vane located in a median section of the horn for maintaining an exponential flare rate and dividing the median section into two vertical slits, for providing a substantially constant coverage angle and wide frequency range of operation for the horn.

Although these prior art examples of horn systems may provide improvements in the frequency response and dispersion of sound from such horns, none teach or describe a relatively simple and inexpensive mechanism for substantially eliminating "beaming", a phenomena caused by a narrowing of the beam width at high frequencies due to the use of substantially large diameter transducers causing improper diffracting of the acoustic wavefront into the horn. Another problem associated with the use of drivers with relatively large exits which diffract acoustical wavefronts from a circular entrance hole into a substantially large width rectangular slot, is drop-out of the high frequency response along the central axis of the horn due to interference between the wavefronts causing cancellation of high frequency sounds.

The present inventor has recognized that one of the major problems with using a large throat such as a 2-inch-throat format, for example, to obtain high output for high-frequency horns is that beaming typically occurs above 10 kHz in conventional horn designs. Such beaming is a consequence of a physical law that states that as the effective area of the sound source increases in size (the diameter of the throat of a driver, for example), the dispersion angle of the sound source decreases at certain frequencies. Accordingly, relatively small-throat designs, that is, smaller than 2-inch throat designs, for example, have better dispersion characteristics. In conducting various experiments, it was discovered that the vertical polar frequency response for a horn with a 2-inch throat had an undesirable drop-out in the frequency range from 7 to 16 kHz. A horn having a 2-inch throat and flared side portions having an angle of 20 degrees from the horizontal, for example, causes a smaller path-length for sound from the throat to the front of the speaker along the central axis in comparison with the path lengths for sound waves reflected from the sides of the horn along paths parallel to the central axis. The lesser path length for sound from the central axis relative to sound reflected from the sides of the horn creates an interference phenomenon which causes drop-out in the higher frequency ranges, and most particularly near 10.5 kHz. The undesirable drop-out or interference effects are magnified when a circular wavefront from a driver is made to change to a rectangular wavefront in that the middle section of the wavefront which thereby approximates a rectangle is not affected by the transition, but the sound energy at the top and bottom of the circular wavefront is compressed into the central portion of the rectangular wavefront. When, for example, sound wave energy exits from a circular waveguide into a rectangular waveguide, the rectangular portion of the circular wavefront fills the rectangular portion of the horn with some regularity, but the components of energy at the center of the wavefront are driven outward in order to fill the rectangular section evenly, resulting in reflection interference and frequency drop-out due to cancellation of the wavefront at certain frequencies.

SUMMARY OF THE INVENTION

In order to overcome the problems in the prior art, it is an object of the present invention to provide a horn-type loudspeaker substantially free from beaming phenomena and drop-out at high frequencies in the polar response curve of the speaker.

Another object of the invention is to provide a relatively inexpensive method and mechanism for permitting a driver of relatively large throat diameter to eject or transmit sound into the throat of a horn for blending into a rectangular-like slot, while avoiding the beaming and interference phenomena usually inherent in such systems.

The present invention provides both a method and apparatus for substantially eliminating beaming and interference phenomena by mounting beam width control means wholly within the throat of the horn, for effectively dividing the throat into a plurality of smaller pseudo-horns for directing and shaping the acoustic wavefronts to the point of termination of the beam width control means within the throat, after which the individual wavefronts mix within the forward portions of the horn to form a coherent wavefront substantially free from interference and beaming effects.

BRIEF DESCRIPTION OF THE DRAWINGS

The present invention will be described with reference to the accompanying drawings in which will items are indicated by the same reference number, and in which.

DETAILED DESCRIPTION OF THE PREFERRED EMBODIMENTS

Figure 1:
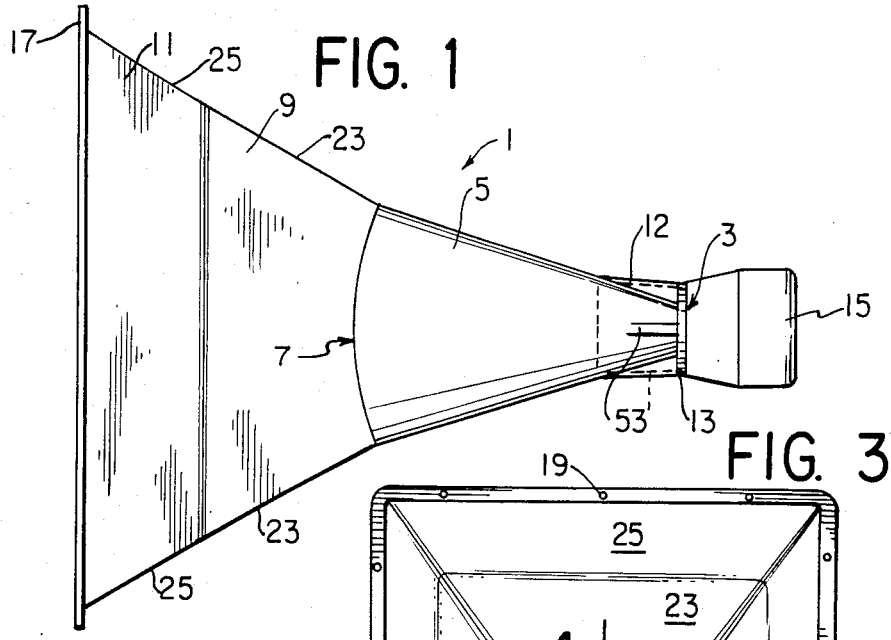
FIG. 1 is a side view of a horn of one embodiment of the present invention.
Figure 2:
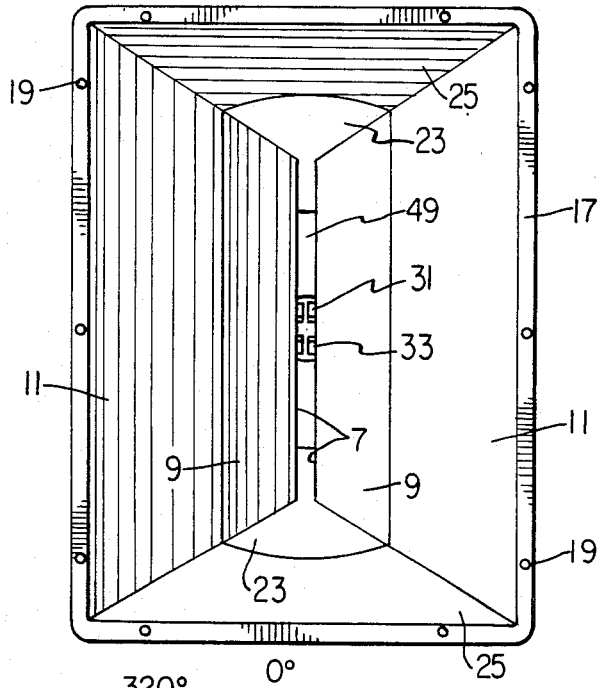
FIG. 2 is a front view of the horn of FIG. 1.

With reference to FIG. 1, the loudspeaker horn 1 of the present invention is a horn 1 including a rearmost located throat insert 3 joined to a slot-like horn portion 5 terminating in an arc-like lip 7 into a flared frontal portion 9, the latter opening into an even greater flared mouth portion 11. The throat insert portion 3 extends into the horn as shown by the phantom lines 12 and includes a flange 13 for receiving a driver 15 (shown in phantom) which is bolted to the flange 13. The driver 15 converts electrical signals into sound or acoustical waves for transmission into the throat insert 3 of the horn. A mounting flange 17 is included about the mouth of the horn 1, and includes a plurality of mounting holes 19, as shown in the front and rear views of the horn speaker in FIGS. 2 and 3, respectively. With reference to the front view of FIG. 2, the mid-section 5 forms a slot 21 as shown, which terminates at the opposing curved lips 7, and from there opens into the flared side portions 9 and 11, and the flared upper portions and lower portions 23 and 25, a shown. The horn speaker 1 is preferably symmetrical about its central vertical and horizontal axes, with one-half of the horn speaker 1 being essentially a mirror image of the other half of the speaker 1. Also, the front of the horn speaker 1 is flat, as shown in FIGS. 1 and 2, and in this example is rectangular in shape.

Figure 3:
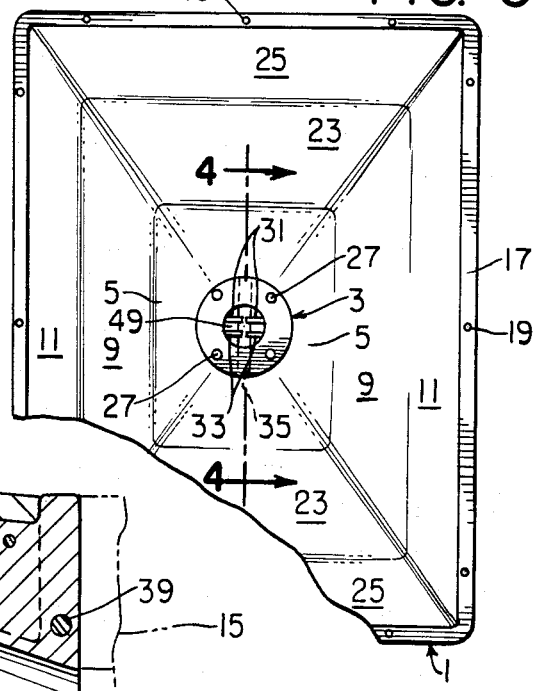
FIG. 3 is a partial rear view of the horn of FIG. 1.

The mouth of the throat insert 3 is centrally located at the bottom of the slot 49, as shown. With further reference to FIG. 3, the throat insert 3 includes a plurality of bolt holes 27 in flange 13 for mounting the driver 15 thereto. Looking into the entry hole 29 of the throat insert 3, two pairs of vanes 31, 33, respectively, are shown, and represent a preferred embodiment of the invention to be described in greater detail below. A slot-like portion of the front of the throat insert 3 is shown in phantom as indicated by reference 35.

Figure 4:
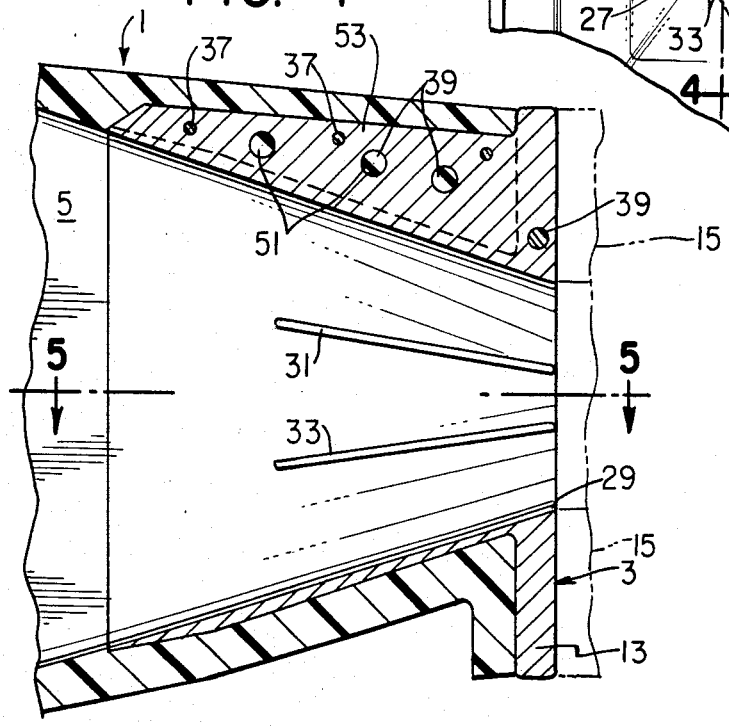
FIG. 4 is partial side sectional view of the horn taken on line 4—4 (centralmost vertical plane of horn) in FIG. 3, particularly showing a sectional view of the throat insert of the horn.

A sectional view of throat insert 3 taken along line 4—4 of FIG. 3 is shown in FIG. 4. Line 4—4 is coincident with the central longitudinal axis of throat insert 3. Each half includes holes 37 and 39 for receiving locking and guide pins (not shown) for securing the two halves of the throat insert together during assembly. Upper and lower vanes 31 and 33, respectively, may be die-cast integrally with each half section, or alternatively may be fabricated separately and joined to the interior surfaces of the throat insert 3 through use of adhesive or other means. The flange angle and separation of the vanes 31, 33 are preferably chosen so that the cross-sectional area of the region between the vanes substantially equals the cross-sectional area between each vane pair and the side wall of the throat section, with that relationship existing at both the front and the back terminations of the vanes. The lengths of the vanes 31 and 33, are determined empirically for obtaining the most uniform inside area progression, for providing the best frequency response characteristic for the particular horn design of interest. The remainder of the horn 1 is fabricated from polyester resin and glass-fiber laminate, in this example with the rear or back portion being integrally molded about the die-cast zinc throat section 3, as shown by the cross section portion 41 of horn 1.

Figure 5:
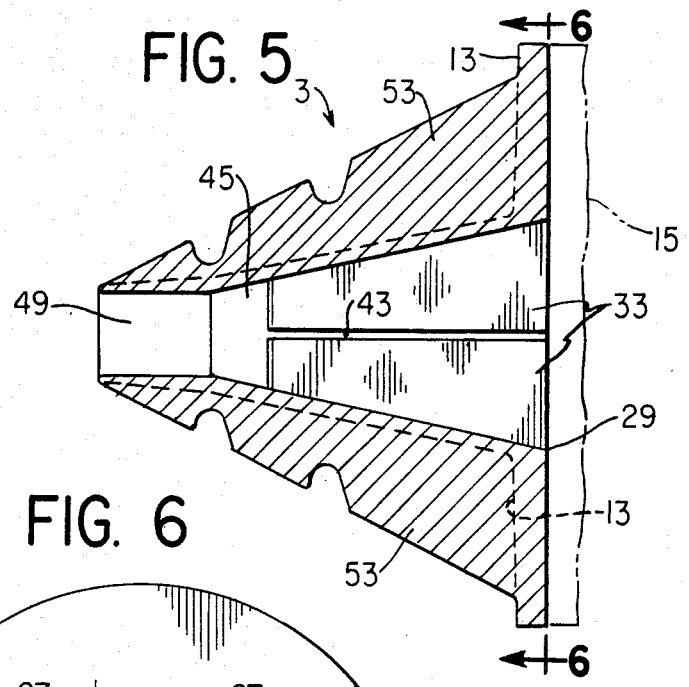
FIG. 5 is a sectional view of the throat insert of the horn taken along line 5—5 (centralmost horizontal plane of horn) of FIG. 4.

The cross section of the throat insert 3 along line 5—5 of FIG. 4, shown in FIG. 5, illustrates that the lower pair of vanes 33 taper inward following the taper of the inside walls of a selected cross-section of the throat insert 3. Note that the vanes 31 and 33 are illustrated as being fabricated in two halves solely for the reason of convenience of fabrication in fabricating the throat insert as two formed halves. Alternatively, the upper and lower vanes 31, 33 respectively, could also be each provided as a single piece vane having the desired tapered shape indicated. The gap 43 left between each pair of the upper and lower vanes 31, 33, respectively, is relatively narrow, and does not affect the performance of the horn speaker 1. The first section 45 of the throat insert 3 is truncated at line 47, and opens into a substantially rectangular shaped slot-like second section 49, as shown. Note that due to the symmetry of the throat insert 3, if a cross section as taken in FIG. 4 along line 5—5 is taken in the opposite direction, the view shown in FIG. 5 would be identical except that the pair of upper vanes 31 would be shown instead of the lower vanes 33.

Figure 6:
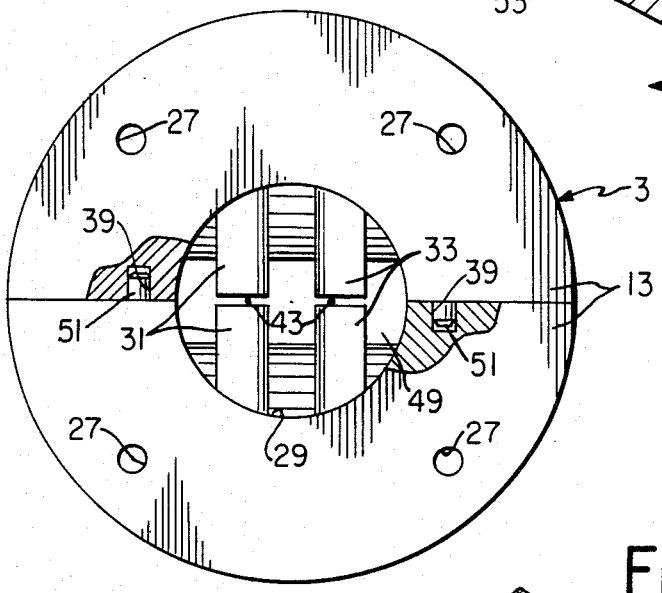
FIG. 6 is a back or rear view of the throat insert taken along line 6—6 of FIG. 5.

A back or rear view of the throat insert 3 taken along line 6—6 of FIG. 5 is shown in FIG. 6, as the assembled halves of the throat insert 3. The partial cutaway view shows the pins 51 friction-fitted into holes 39 for securing the two halves together. Other methods of assembling the two halves of the throat insert 3 may be used rather than the pinning method illustrated herein; for example, epoxies or other appropriate adhesives could be used, as could metal bonding methods, and so forth. Note also that the pairs of vanes 31, 33, respectively, are mounted at an angle to the central vertical plane of the rear view of the throat insert 3 of this FIG. 6. A side view of the speaker horn 1 shown in FIG. 1 and is a mirror image of the other side view thereof. Note that strengthening ribs 53 are shown at the rear of the speaker horn 1.

In one illustrative embodiment of the invention, represented by Electro-Voice Model 9040 loudspeaker horn, the throat section 3 has an entry opening 29 of circular shape, about 2 inches in diameter. It has an exit opening which is substantially rectangular in shape, about $\frac{3}{4}''$ by $3\frac{7}{8}''$, with a throat length of 3 inches. The throat merges smoothly from the 2-inch diameter entry opening to the rectangular exit opening, as shown by the following table, where dimension A represents the distance from the entry opening toward the exit opening, dimension B represents the length of the cross-section opening, and dimension C represents the width of the cross-section opening, at various points along the length of the throat section at distances A from the entry point. At each distance A, the cross-section is rounded, with the length and width indicated.

| DIM. "A" | DIM. "B" | DIM. "C" |
|---|---|---|
| 0.000 | 1.938 | 1.938 |
| 0.500 | 2.256 | 1.740 |
| 1.000 | 2.574 | 1.542 |
| 1.500 | 2.893 | 1.344 |
| 2.000 | 3.211 | 1.146 |
| 2.500 | 3.530 | 0.948 |
| 3.000 | 3.848 | 0.750 |

Figure 7:
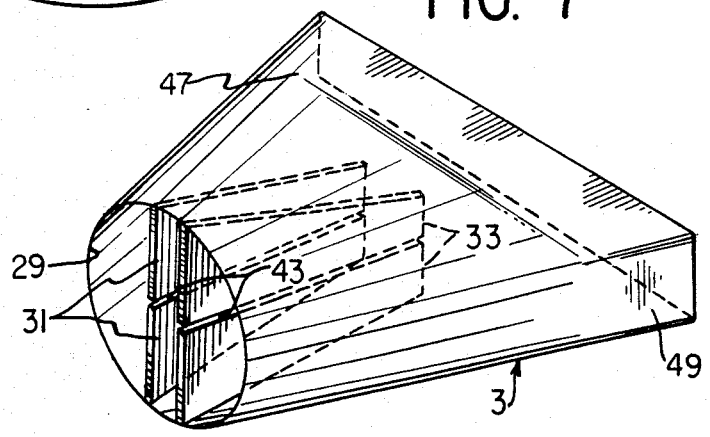
FIG. 7 is an out of scale pictorial view showing a portion of the acoustical internal pathway of one embodiment of the invention.

The throat section forms a smooth transition from the circular entry opening to the rectangular exit opening, by flattening the cross-section in one dimension (e.g. horizontally) and stretching it in the perpendicular dimension (e.g. vertically). In FIG. 7, an exaggerated and out of scale phantom pictorial of the transition of the throat 3 from a circular entry hole 29 to a rectangular slot 49 is partially shown.

In this illustrative embodiment, the flaring vanes are spaced apart at the entry opening by 0.5 inch and extend from the entry opening toward the exit opening for a distance of substantially $2\frac{1}{2}$ inches. At their termination point, the vanes are spaced substantially at 1.16 inches, while the elongated opeinng at this point is approximately 3.5 inches. As indicated previously the vanes flare outwardly in a manner such that the ratios of the cross-sectional areas of the three psuedo-horns formed by the vanes and the wall of the throat are substantially equal at both the front edge and back edge of the vanes.

The horn extending from the exit point of the throat section is a conventional rectangular cross-section horn, which in this instance produces a substantially 40 degree vertical beam. For a 20 degree horn, the vanes might extend approximately $3\frac{1}{4}$ inches from the entry opening.

It will be understood that for other beam widths, other conventional rectangular cross-section horns would be used, and the throat section would have an axial length and exit cross-section variation corresponding to the horn of the specified beam width. By way of example, a 20-degree horn might have a throat section of axial length of about 4 inches, serving as a transition between a 2 inch diameter circular entry opening and a $3\frac{1}{2}$ inch by $1\frac{1}{4}$ inch exit opening. In this 20-degree beam horn, the vanes may be spaced about 1 inch apart at their termination point. Correspondingly, for a 60-degree beam horn, the throat section might be $2\frac{1}{2}$ inches long in axial extent, with a 2 inch diameter entry opening merging to a 5 inch by $1\frac{1}{4}$ inch rectangular exit opening, with the vanes extending for a distance of about $1\frac{1}{2}$ inches from the entry opening and spaced about $1\frac{1}{4}$ inches apart at their termination point.

Operation of the preferred embodiment of the present invention can most easily be described with reference to FIG. 7. In FIG. 7, solely for the purposes of illustration, an out-of-scale pictorial view is shown including the various portions of passageways for sound to travel from the entry hole 29 of the throat insert 3 to the slit portion 21 of horn 1. However, before more particularly describing the operation of the invention, it may be helpful to discuss in more detail the problems solved by the present inventive use of the pairs of vanes 31 and 33. Without the use of these vanes 31, 33, when, for example, a 2-inch-diameter entrance hole, such as entry hole 29 of throat insert 3, receives sound from a 2-inch exit of a driver 15 (for example), which is blended from the throat 3 to a 1-inch-wide slot, such as slot 49 and flared slot 21, two undesirable effects were observed. One effect is that at particular frequencies, there occurs a drop-out in the on-axis sound pressure level relative to the sound pressure level slightly off-axis. A second effect that limits the performance of a horn loudspeaker is the occurrence of narrowing of the beam width (called beaming) at high frequencies, resulting from the 2-inch-wide entry opening 29 of the throat being too wide to properly diffract the wavefront into the horn 1. It was discovered that these undesirable effects can be eliminated from the useful frequency range of a typical loudspeaker horn, in accordance with the present invention, by inserting appropriately designed beamwidth control vanes 31, 33 in the throat 3 of the horn 1.

After much experimentation, it was recognized that the throat 3 or early part of the horn 1 is generally too large to function correctly for very short wavelengths of sound: since the dimensions of the throat are of an order of several wavelengths at high-frequency sound, the wavefronts of such frequencies will have directional characteristics, resulting in the previously mentioned diffractive phenomena known as beaming, and causing on-axis drop-out of desired sound at particular frequencies. One solution to overcome these undesirable effects is to decrease the size of the throat 3, where possible. However, where such reduction in throat size is not possible, according to the present invention, the throat 3 may be divided through use of the vanes 31 and 33 into several smaller "psuedo-horns", each of which is small enough to provide the proper dispersion of the wavefronts for substantially eliminating the previously mentioned problems. It was further discovered that at the point within the throat 3 where the wavefronts have obtained the proper shape and directionality, the vanes 31, 33 may be terminated, for permitting the individual wavefronts to join or mix into one coherent wavefront for further distribution into the remaining forward portions of the horn 1.

The vanes 31 and 33 divide the rear portion of the throat 3 into three "pseudo-horns". In the preferred embodiment, it is important that the ratio of the areas of the cross sections of each one of these "pseudo-horns" be the same at the front of the vanes 31, 33, as at the back of the vanes 31, 33, and at points in between. For example, a pseudo-horn section which occupies 30% of the throat area at the front of the respective vanes 31, 33 should also occupy 30% of the cross-sectional area at the back of the vanes 31, 33, associated therewith. In this manner, the sound energy will be distributed evenly over the cross section of each "pseudo-horn", and will mix properly with the sound emitted from the other two "pseudo-horns" for forming a coherent wavefront. It was also determined that the optimum length of the vanes 31, 33 should be derived experimentally for the particular horn system in which they are to be used. If the vanes 31, 33 are too short, they will not correct the directional anomaly, and if they are too long, the resulting frequency response of the horn will be rough or irregular, due to the interactions between the three apparently distinct sound sources represented by the three "pseudo-horns" formed through use of the vanes 31, 33. However, the vanes are terminated short of the outlet of the throat section 3. Also, the placement of the vanes 31, 33 with respect to the axis is determined from the dimensions of the horn 1.

Figure 8:
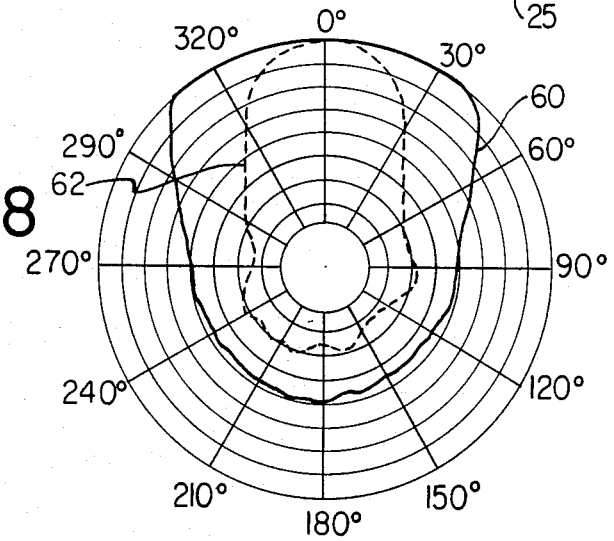
FIG. 8 shows the horizontal and vertical polar frequency response curves of a loudspeaker horn incorporating one embodiment of the invention.

The present inventive vanes 31, 33 have very recently been incorporated in the HP family of wide-range, high-frequency, constant-directivity horns of Electro-Voice Inc. FIGS. 1–7 substantially represent the Electro-Voice® model HP9040 constant-directivity horn, which includes the vaned waveguide throat 3 of the present invention for providing substantially improved high-frequency control, especially in the vertical polar response of the horn, in comparison to similar 2-inch throat horn designs not using the vanes 31, 33 of the present invention. For example, as shown in FIG. 8, the polar frequency response plot 10 kHz is particularly smooth because of the vanes 31, 33. The solid line curve 60 represents polar characteristic in the horizontal plane, whereas the dashed response curve 62 represents the polar characteristics in the vertical plane, for this particular horn speaker design. Similar very regular polar frequency response curves are obtained when plotting the polar response from 500 Hz to beyond 16 kHz. If the vanes 31, 33 are eliminated from the throat, the polar response curves for the horn speaker, especially in the vertical response between 7 and 16 kHz, for example, would exhibit undesirable drop-outs, especially between 330 degrees and 30 degrees of the vertical polar plot.

Although particular embodiments of the present invention have been shown and described herein, such illustrative embodiments of the invention are not meant to be limiting, and variations therefrom are to be deemed within the scope and spirit of the appended claims hereto.

What is claimed is:

1. In a high-frequency, constant-directivity loudspeaker horn including a relatively large-throat driver transducer coupled to a circular entry opening of similar diameter at an initial throat section of said horn, where said throat section terminates in a rectangular slot-like exit opening having a width substantially less than the throat entry diameter, an improvement for avoiding undesirable acoustic effects resulting both in interference causing a drop-out or reduced response at particular frequencies, and in "beaming" or narrowing of the beam width at high frequencies, due to both the relatively large diameter driver and horn throat, wherein the improvement comprises:

beamwidth control means rigidly mounted wholly within said throat section, between said throat entry opening and a predetermined throat termination point, for effectively dividing said throat section into a plurality of smaller psuedo horns for directing and shaping the acoustic wavefronts to said termination point, beyond which the individual wavefronts exiting from said psuedo horns mix within said horn to form a coherent wavefront substantially free from interference and beaming effects;

said throat section forming a smooth transition from its circular entry opening to its rectangular exit opening via successively increased flattening of its cross-section in one dimension, and stretching of its cross section in another dimension perpendicular to the one dimension.

2. The improvement of claim 1, wherein said beamwidth control means includes first and second vanes located one on either side of a central longitidinal axis of said throat section and at an angle to said axis, said first and second vanes each extending between opposing sides of said throat section forward of the throat entry opening to a termination point.

3. The improvement of claim 1, wherein each one of said plurality of small pseudo horns individually occupies the same percentage of throat area at the entry opening and at the throat termination point.

4. The improvement of claim 2, wherein the inner and outer portions of the psuedo horns formed by said first and second vanes each individually occupy the same percentage of area of said throat section.

5. A method for substantially eliminating "beaming" and other interference phenomena causing dropout at particular frequencies, and for improving the response of an acoustical horn including a rearwardly located throat section of relatively large diameter throat opening and a forwardly outward flaring rectangular horn, said throat section being adapted to be driven by a circular transducer of relatively large diameter, said method comprising the steps of:

(1) forming a circular entry opening in said throat section for connection to said circular transducer;

(2) forming a rectangular exit opening in said throat section for connection to said rectangular horn;

(3) forming a smooth transition from said circular entry opening to said rectangular exit opening of said throat section via successively increased flatening of its cross section in one dimension, and stretching of its cross section in another dimension;

(4) dividing a portion of the area of said throat section into a plurality of smaller horns; and (5) determining the length of said smaller horns to eliminate said dropout for obtaining the best frequency response polar curve.

6. The method of claim 5 further including the step of:

(6) determining the angle of interior wall portions of said pseudo horns relative to the horizontal plane about the longitudinal central axis of said throat section, for obtaining the best polar frequency response characteristic for said horn.

7. An acoustical constant-directivity loudspeaker horn comprising:

a rearwardly located throat section, including means for receiving and mounting thereon a transducer driver means for converting electrical signals to sound waves, said throat section having a centrally located circular entry opening leading into a first cavity inwardly tapered in one direction and outwardly flaring in a perpendicular direction followed by slot-like second throat section cavity;

said horn having a rearwardly tapered slot-like mid-section cavity joined to an exit portion of said slot-like second throat section cavity said horn also having an outwardly flaring front section joined to an exit portion of said slot-like mid-section horn cavity; and first and second vanes mounted wholly within said first cavity of said throat section on either side of the longitudinal axis of said horn, with said first and second vanes being oriented perpendicular to and symmetrically about the central plane of said horn, said first and second vanes serving to direct and shape the sound waves emitted from said driver means to the point of termination of said first and second vanes for ensuring mixing of the sound waves beyond said point of termination to form a coherent wavefront substantially free from beaming effect and associated interference between said sound wave otherwise causing drop-out at certain frequencies, thereby providing substantially smooth polar frequency response curves in both of two mutually perpendicular planes for said horn.

8. The horn of claim 7, wherein said first and second vanes each have flat transverse faces.

9. The horn of claims 7 or 8, wherein said first and second vanes have edges tapering inward at substantially the same rate of taper as opposing inwardly tapering faces of said first cavity to which outer edges of said first and second vanes are attached, with opposing faces of said vanes diverging away from one another at an angle from the entry opening determined to provide a desired polar response for said horn.

10. The horn of claim 9, wherein said first and second vanes are truncated substantially before the slot-like second cavity of said throat section.

11. The horn of claim 7, wherein said throat section and said first and second vanes are bifurcated along the longitudinal axis thereof for ease of assembly, and include means for rigidly assembling the bifurcated sections together.

12. The horn of claims 7 or 11, wherein said throat section consists of die-cast zinc.

13. The horn of claim 12, wherein said horn front section and mid-section consist of plastic material, with the rear portion of said mid-section being integrally molded to said throat section.

14. The horn of claim 7, wherein the outer opening of said front section is uniplanar.

15. The horn of claim 7, wherein said first and second vanes effectively divide the cross-section of said horn into three smaller cross-sections, in which the ratios of the area of the cross-section of each of these smaller cross-sections to the total cross-section area are the same at the front of the vanes as at the rear of the vanes.

* * * * *